US010487765B2

(12) United States Patent
Maeda et al.

(10) Patent No.: US 10,487,765 B2
(45) Date of Patent: Nov. 26, 2019

(54) FAILURE DETECTION APPARATUS FOR FUEL SYSTEMS OF ENGINE

(71) Applicant: MITSUBISHI JIDOSHA KOGYO KABUSHIKI KAISHA, Tokyo (JP)

(72) Inventors: Satoshi Maeda, Tokyo (JP); Junya Kitada, Tokyo (JP); Hideo Matsunaga, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/054,567

(22) Filed: Aug. 3, 2018

(65) Prior Publication Data

US 2019/0040811 A1 Feb. 7, 2019

(30) Foreign Application Priority Data

Aug. 4, 2017 (JP) ..... 2017-151748

(51) Int. Cl.
*F02D 41/14* (2006.01)
*F02D 41/22* (2006.01)
(Continued)

(52) U.S. Cl.
CPC ..... *F02D 41/1495* (2013.01); *F02D 41/0037* (2013.01); *F02D 41/047* (2013.01); *F02D 41/221* (2013.01); *F02D 41/2454* (2013.01); *F02D 41/2461* (2013.01); *F02D 41/3094* (2013.01); *F02D 41/1456* (2013.01); *F02D 41/18* (2013.01); *F02D 2041/225* (2013.01)

(58) Field of Classification Search
CPC ..... F02D 41/14; F02D 41/1495; F02D 41/410037; F02D 41/047; F02D 41/221; F02D 41/2454; F02D 41/2461; F02D 41/3094; F02D 41/1456; F02D 41/18; F02D 2041/225
See application file for complete search history.

(56) References Cited

U.S. PATENT DOCUMENTS 5,590,634 A * 1/1997 Shinohara ..... F02M 25/0809 123/198 D
6,932,068 B2 * 8/2005 Osanai ..... F02D 41/004 123/520
7,017,558 B2 * 3/2006 Osanai ..... F02D 41/0045 123/198 D

FOREIGN PATENT DOCUMENTS

JP 5724963 B2 5/2015

* cited by examiner

*Primary Examiner* — Hieu T Vo
(74) *Attorney, Agent, or Firm* — Birch, Stewart, Kolasch & Birch, LLP

(57) ABSTRACT

A failure detection apparatus for fuel systems of an engine includes a first failure determiner executing, while the engine is in each of a first injection form and a second injection form, a failure determination process on the corresponding fuel system, a second failure determiner executing, when the first failure determiner determines occurrence of a failure in one of the injection forms, a failure determination process on the fuel system corresponding to the other injection form, a failure locator determining whether or not the failure has occurred, for each of the fuel systems responsible for the first and second injection forms, based on a result by the second failure determiner, and a purge process prohibiter prohibiting execution of a purge process for the engine. The second failure determiner causes the purge process prohibiter to prohibit execution of the purge process, when executing the failure determination process on the fuel system.

8 Claims, 5 Drawing Sheets

(51) Int. Cl.

| | |
|---|---|
| ***F02D 41/24*** | (2006.01) |
| ***F02D 41/04*** | (2006.01) |
| ***F02D 41/30*** | (2006.01) |
| ***F02D 41/00*** | (2006.01) |
| *F02D 41/18* | (2006.01) |

FAILURE DETECTION APPARATUS FOR FUEL SYSTEMS OF ENGINE

BACKGROUND

Technical Field

This disclosure relates to a failure detection apparatus for fuel systems of an engine, and in particular, to a failure detection apparatus for fuel systems intended for an engine capable of switching between a plurality of different injection forms.

Description of the Related Art

A failure in a fuel system provided in an engine leads directly to adverse effects such as deterioration of exhaust gas characteristics attributed to an inappropriate air-fuel ratio. Thus, a function to detect a failure in the fuel system is legally demanded, and when a failure is detected, a driver is prompted to do needed repairs by failure indication and a failure code is stored in an ECU controlling the engine so that the failure code is available for later repairs.

The inventor noted for a conventional failure detection apparatus for a fuel system intended for an engine with a single injection form, for example, port injection, a technique is available that focuses on increases in a learning value of the air-fuel ratio and a feedback correction integrated value (hereinafter referred to as the integrated value) resulting from a failure in the fuel system. The fuel injection amount of the engine is sequentially corrected based on an integrated value of a difference between a target value and a measured value of the air-fuel ratio. When the integrated value remains biased toward a rich side or a lean side for a given period, the learning value corresponding to a steady component of the integrated value is updated to correct a median of an output from an air-fuel ratio sensor such as a linear air-fuel ratio sensor (LAFS). This keeps an exhaust air-fuel ratio at a target air-fuel ratio.

When the fuel system fails, even if the learning value reaches a correction limit, the target air-fuel ratio is precluded from being maintained and correction is performed based on the integrated value. Thus, on condition that the learning value reaches the correction limit and that the integrated value reaches a predetermined failure determination value, occurrence of a failure is determined for the fuel system.

Besides such a conventional failure detection apparatus for a fuel system, for example, Japanese Patent No. 5724963 proposes a failure detection apparatus for fuel systems intended for an engine capable of switching between port injection and cylinder injection. The technique in Japanese Patent No. 5724963 involves diagnosing imbalance abnormality based on a rotational fluctuation of the engine while the engine is in operation with port injection and with cylinder injection, and if imbalance abnormality is diagnosed in one of the injection forms, determining occurrence of a failure in a location constituting the fuel system in this injection form, for example, a port injector or a cylinder injector.

A rotational fluctuation of the engine (imbalance abnormality), which is used as an indicator for failure determination for the fuel systems in Japanese Patent No. 5724963, may result from a factor other than a failure in the fuel system itself. For example, a fluctuation may result from an increase or a decrease in intake air amount caused by deposits or leakage in an intake system or a malfunction in an ignition system. Even in a situation where any of these external factors other than in the fuel system occurs, a rotational fluctuation may occur, leading to a determination of occurrence of a failure. This means that a determination of occurrence of a failure in any injection form involves the external factors other than a failure in the fuel system itself for which the failure determination is made.

Thus, according to the technique in Japanese Patent No. 5724963, even if the fuel systems themselves are normal, an external factor may lead to a determination of occurrence of a failure, with a failure code for the incorrect fuel system stored. Of course, even if an attempt is made to make a determination again for the injection form for which occurrence of a failure has been determined, the same determination result is obtained, preventing improvement of reliability. Such a problem attributed to the external factor may similarly occur in the above-described single injection form, for which a deviation in air-fuel ratio (an increase in integrated value or learning value) is used as an indicator, for example, in a failure detection apparatus for a port injection engine.

SUMMARY

An aspect of the present invention is a failure detection apparatus for fuel systems of an engine capable of switching between a first injection form and a second injection form includes a first failure determiner executing, while the engine is in operation in each of the first and second injection forms, a failure determination process on the corresponding fuel system, a second failure determiner executing, when the first failure determiner determines occurrence of a failure during operation in one of the injection forms, a failure determination process on the fuel system corresponding to the other injection form during operation in the other injection form, a failure locator assertively determining whether or not the failure has occurred, for each of the fuel systems responsible for the first and second injection forms, based on a result of the failure determination process by the second failure determiner, and a purge process prohibiter prohibiting execution of a purge process of causing fuel evaporative emissions generated in a fuel tank to be adsorbed to a canister and introducing the fuel evaporative emissions into a cylinder while the engine is in operation. When the second failure determiner executes the failure determination process on the fuel system, the second failure determiner causes the purge process prohibiter to prohibit execution of the purge process.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION

An embodiment of a failure detection apparatus for fuel systems of an engine in which the present invention is embodied.

Figure 1:
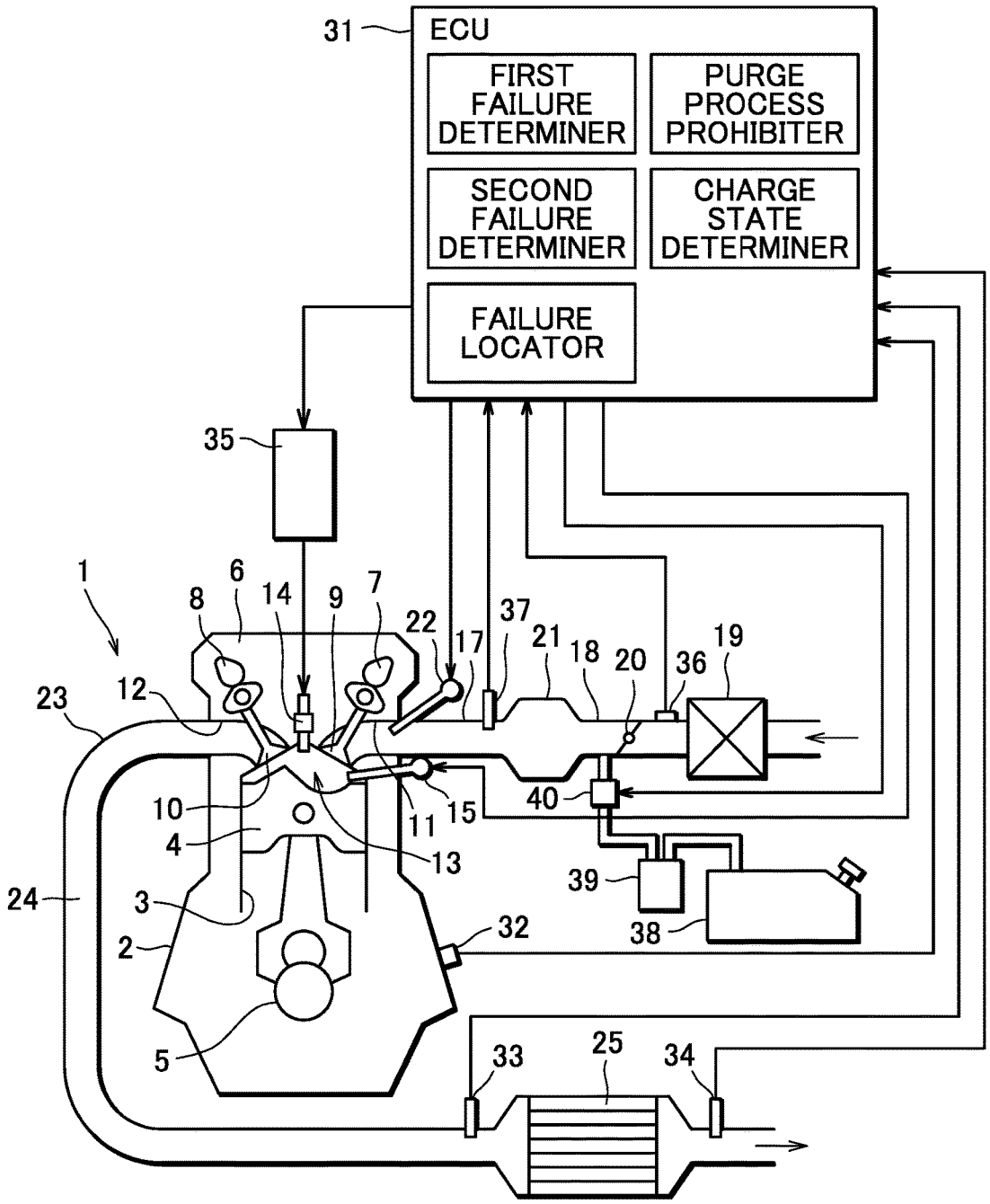
FIG. 1 is a diagram illustrating a general configuration of an engine to which a failure detection apparatus for fuel systems according to an embodiment of the present invention is applied.

FIG. 1 is a diagram illustrating a general configuration of an engine to which the failure detection apparatus for fuel systems according to the present embodiment. An engine 1 according to the present embodiment is configured to be switchable between two injection forms respectively involving port injection (a first injection form in the present invention; hereinafter referred to as the MPI mode) and a combination of port injection and cylinder injection (a second injection form in the present invention; hereinafter referred to as the MPI+DI mode).

A piston 4 is disposed in each cylinder 3 formed in a cylinder block 2 of the engine 1, and each piston 4 slides in the cylinder 3 in response to rotation of a crank shaft 5. An intake cam shaft 7 and an exhaust cam shaft 8 provided in the cylinder head 6 are rotationally driven in conjunction with a crank shaft 5, and an intake valve 9 and an exhaust valve 10 of each cylinder are driven by the cam shafts 7, 8 to open and close an intake port 11 and an exhaust port 12 at predetermined crank angles. An ignition plug 14 and a cylinder injector 15 are attached to each cylinder of the cylinder head 6 in such a manner as to face the inside of a combustion chamber 13.

A downstream end of an intake passage 18 is connected to the intake port 11 of each cylinder via an intake manifold 17, and the intake passage 18 is provided with an air cleaner 19, a throttle valve 20, a surge tank 21, and a port injector 22 arranged in this order from an upstream side. Although not illustrated in the drawings, fuel at a predetermined pressure discharged from a feed pump is fed to the port injector 22. The fuel is further pressurized by a high-pressure pump, and the pressurized fuel is fed to the cylinder injector 15. Therefore, fuel is injected into the intake port 11 in response to opening or closing of the port injector 22, and injected into the combustion chamber 13 (into the cylinder) in response to opening and closing of the cylinder injector 15.

On the other hand, an upstream end of an exhaust passage 24 is connected to the exhaust port 12 of each cylinder via an exhaust manifold 23, and the exhaust passage 24 is provided with a three way catalyst 25 and a muffler not illustrated in the drawings.

While the engine 1 is in operation, intake air introduced into the intake passage 18 through the air cleaner 19 has a flow rate thereof adjusted by the throttle valve 20 and is then distributed to each cylinder by the intake manifold 17 and fed into the combustion chamber 13 through the intake port 11. In the MPI mode, fuel injected from the port injector 22 is mixed with intake air and introduced into the combustion chamber 13 in conjunction with opening of the intake valve 9. In the MPI+DI mode, the fuel is further injected from the cylinder injector 15 directly into the combustion chamber 13.

In either mode, ignition of the ignition plug 14 causes the fuel in the combustion chamber 13 to be combusted, and a resultant combustion pressure causes the crank shaft 5 to be rotationally driven via the piston 4. Exhaust gas resulting from the combustion is discharged from the inside of the combustion chamber 13 to the exhaust port 12 in conjunction with opening of the exhaust valve 10. The exhaust gas is gathered by the exhaust manifold 23, and the gathered exhaust gas is purified by the three way catalyst 25 in the exhaust passage 24 and then discharged.

An engine control unit (ECU) 31 is installed in a vehicle interior, and includes an input/output device, storage devices (ROM, RAM, and the like) used to store control programs, control maps, and the like, a central processing unit (CPU), a timer counter, and the like, none of which are illustrated in the drawings, to comprehensively control the engine 1. Commands for executing processing described below are stored in the storage devices in the ECU 31, for example, in a nonvolatile RAM. An input side of the ECU 31 connects to various sensors such as a crank angle sensor 32 outputting a crank angle signal in synchronism with rotation of the engine 1, a linear air-fuel ratio sensor (LAFS) 33 disposed upstream of the three way catalyst 25 to detect an exhaust air-fuel ratio, an $O_2$ sensor 34 disposed downstream of the three way catalyst 25 to detect an oxygen concentration in exhaust air, an AFS 36 (an air flow sensor and an intake air amount detector according to the present invention) detecting an intake air amount Qa, and an intake air pressure sensor 37 (intake air pressure detector) detecting an intake manifold pressure Pin (negative pressure) generated in the intake manifold 17. An output side of the ECU 31 connects to various devices such as an igniter 35 driving the ignition plug 14 and the port injector 22 and the cylinder injector 15 of each cylinder.

The ECU 31 operates the engine 1 based on detection information from each sensor. For example, the ECU 31 selects the MPI mode or the MPI+DI mode as the injection form according to an engine operation region based on a predetermined control map, determines an ignition period, a fuel injection amount, and the like for the injection form, and controllably drives the igniter 35 and the injectors 15 and 22 based on the determined target values.

For example, for fuel injection control, the ECU 31 performs air-fuel ratio feedback to make the air-fuel ratio on the upstream side of the three way catalyst 25 equal to a target air-fuel ratio (for example, the stoichiometric ratio) based on an output from the LAFS 33. The ECU 31 sequentially corrects the fuel injection amount based on an integrated value of a difference between the target value of the air-fuel ratio and an actual air-fuel ratio detected by the LAFS 33, and sequentially updates a learning value in a direction in which a fluctuation in integrated value toward a rich side or a lean side is corrected and applies the updated learning value to correct the LAFS output. The learning value is individually set for each injection form, and hereinafter differentiated as an MPI learning value and a DI learning value. In parallel with this, the ECU 31 also performs air-fuel ratio sub-feedback based on an output from the $O_2$ sensor 34 to reflect a learning result corresponding to the oxygen concentration on a downstream side of the three way catalyst 25 in correction of the LAFS output.

In the present embodiment, the ECU 31 makes failure determinations for the fuel systems respectively responsible for the MPI mode and the MPI+DI mode based on the integrated value of the difference between the target value and measured value of the air-fuel ratio and on the learning value. More specifically, in the MPI mode, executed using only the MPI fuel system, a failure determination is made for the MPI fuel system (port injection fuel system), and in the MPI+DI mode, executed using both the MPI fuel system and the DI fuel system, a failure determination is made for the DI fuel system (cylinder injection fuel system), with the MPI fuel system excluded.

As described in Description of the Related Art, the technique in Japanese Patent No. 5724963 determines occurrence of a failure not only in a case where at least one of the fuel systems fails but also in a case where another, external factor (a failure in the intake system or the ignition system) occurs, and is thus disadvantageously not reliable in failure determination.

In view of these problems, the inventor focuses on the following point of the engine 1, which switches between the two (or a plurality of) injection forms as in the present embodiment: since both injection forms are affected by external factors, occurrence of a failure is determined in both injection forms if any external factor occurs.

That is, determining occurrence of a failure in only one of the injection forms precludes determination of whether the fuel system itself has failed or the failure is attributed to any external factor. However, in this case, if occurrence of a failure in the other injection form is negated (the other injection form is determined to be normal), not only is the fuel system in the other injection form determined to be normal but also the absence of external factors is determined. This is because normal execution of an injection form needs normal functioning not only of the fuel system in the injection form but also of the entire engine operation system. As a result, also when occurrence of a failure is determined in the last one of the injection forms, the intake system and the ignition system may be assumed to be functioning normally with no external factors occurring, and the determination of occurrence of a failure in spite of such a normal status may be assertively determined to be attributed to a failure in the fuel system itself that corresponds to the one of the injection forms.

Based on the above-described knowledge, a failure determination process for the fuel systems executed by the ECU 31 will be described.

Figure 2:
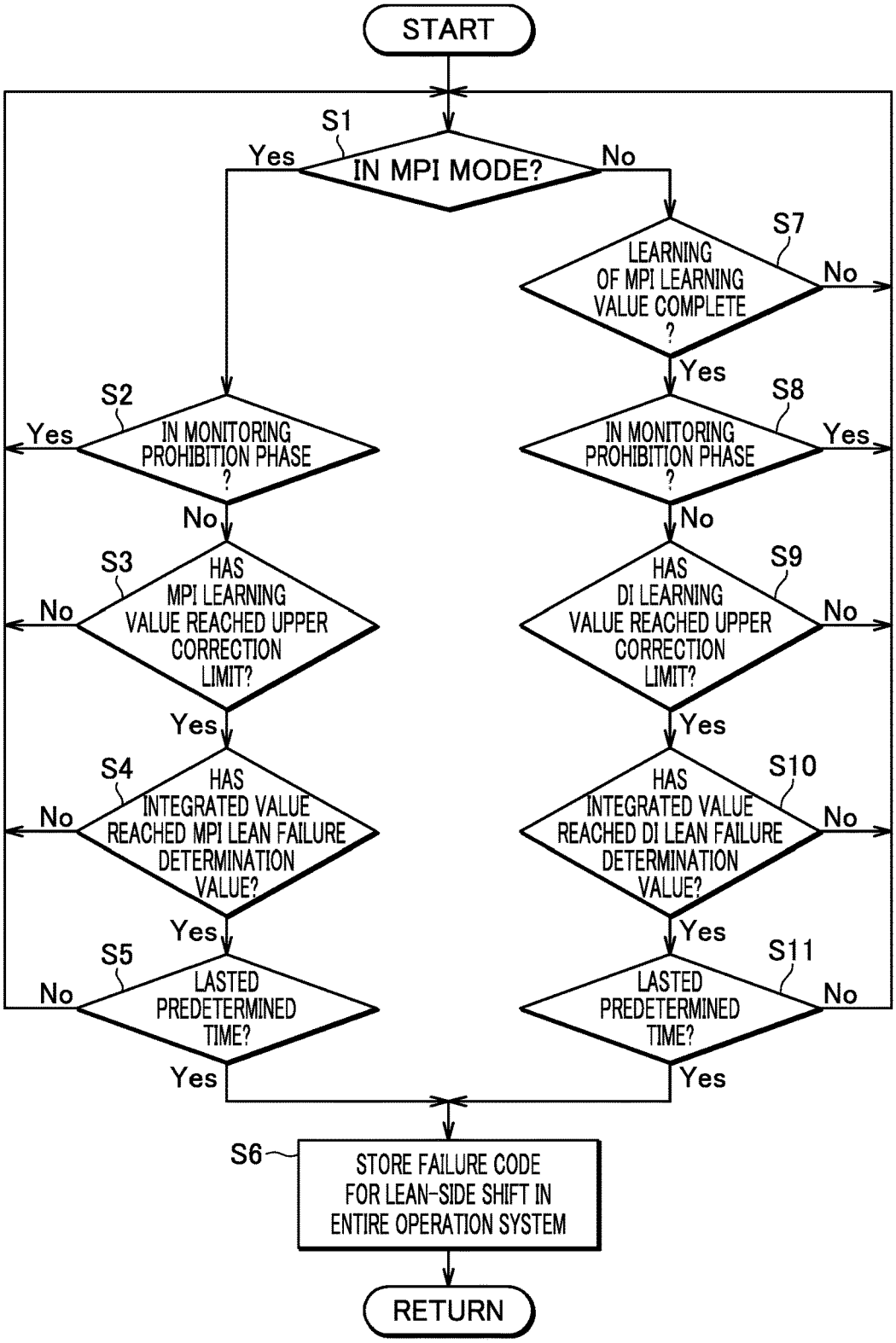
FIG. 2 is a flowchart illustrating a lean-side air-fuel ratio shift failure determination routine executed by an ECU 31 in FIG. 1.

FIG. 2 is a flowchart illustrating a lean-side air-fuel ratio shift failure determination routine executed by the ECU 31. The routine involves determining occurrence of a failure when the air-fuel ratio fluctuates toward the lean side, and is executed by the ECU 31 at predetermined control intervals during operation of the engine 1 (first failure determiner).

First, in step S1, the ECU 31 determines whether or not the engine is in the MPI mode. When the determination is Yes (affirmative), the ECU 31 determines in step S2 whether or not a monitoring prohibition phase is being executed. The processing in step S2 is intended to prevent an erroneous determination resulting from a fluctuation in air-fuel ratio that may occur immediately after switching of the injection form, and the monitoring prohibition phase is set as a period until the air-fuel ratio having temporarily fluctuated by switching of the injection form is stabilized. Thus, when the determination in step S2 is Yes, the determination may be erroneous, and the routine returns to step S1. When the time of the monitoring prohibition phase has elapsed and the determination in step S2 is No (negative), the determination is unlikely to be erroneous and the routine shifts to step S3.

The ECU 31 determines in step S3 whether or not the MPI learning value has reached a preset upper correction limit, and in the subsequent step S4 whether or not the integrated value has reached a preset MPI lean failure determination value.

The processing in steps S3 and S4 is intended to make a failure determination based on fluctuation statuses of the MPI learning value and the integrated value. That is, a situation is normally unlikely where, even when the MPI learning value reaches the upper correction limit, a fluctuation in air-fuel ratio toward the lean side fails to be suppressed, and where the integrated value reaches the MPI lean failure determination value to compensate for the failure to suppress the fluctuation. The situation is thus assumed to indicate occurrence of a certain failure.

When both conditions in steps S3 and S4 are satisfied, the routine shifts to step S5. The ECU 31 determines whether or not the conditions have lasted a predetermined time (for example, 5 sec), and when the determination is Yes, the routine shifts to step S6.

In step S6, the failure code is stored, and subsequently, the routine is ended. Although occurrence of the failure is determined during the MPI mode, at this point in time, the failure may not only have occurred in the MPI fuel system but may also be attributed to an external factor such as a failure in the intake system or the ignition system, thus precluding determination of the cause of the failure. Thus, a failure code is stored that is indicative of a lean-side air-fuel ratio shift failure attributed to any location of the entire operation system of the engine 1.

On the other hand, if the determination in step S1 is No, indicating that the engine is in the MPI+DI mode, the routine shifts to step S7. In step S7, the ECU 31 determines whether or not learning of the MPI learning value is completed after connection of an in-vehicle battery. This processing is intended to extract a failure in the DI fuel system in the MPI+DI mode, which uses both the MPI fuel system and the DI fuel system. That is, if learning of the MPI learning value is not completed, even when occurrence of a failure is determined in the MPI+DI mode, the determination of whether the failure is occurring in the MPI fuel system or in the DI fuel system is precluded. If learning of the MPI learning value is completed, the MPI fuel system may be assertively determined to be functioning normally, and the determination of occurrence of a failure may be assumed to be attributed to the DI fuel system side. Thus, a failure determination during the subsequent MPI+DI mode is made on condition that learning of the MPI learning value is completed.

When the determination in step S7 is No, the routine returns to step S1 to wait for learning of the MPI learning value to complete. When the determination in step S7 is Yes, the routine shifts to step S8. A failure determination during the MPI+DI mode is basically similar to the above-described failure determination in the MPI mode and will thus be summarized below. When the time of the monitoring prohibition phase elapses in step S8, the ECU 31 determines in step S9 whether or not a DI learning value has reached an upper correction limit, and in the subsequent step S10 whether or not the integrated value has reached a DI lean failure determination value. The upper correction limit in this case has a value different from that of the upper correction limit in the MPI mode.

When the conditions in steps S9 and S10 remain satisfied for a predetermined time, a determination in step S11 is Yes and the routine shifts to step S6. In step S6, as is the case with the above-described MPI mode, the failure code is stored that is indicative of a lean-side air-fuel ratio shift failure in the entire operation system for the engine 1. The routine is thus ended.

Figure 3:
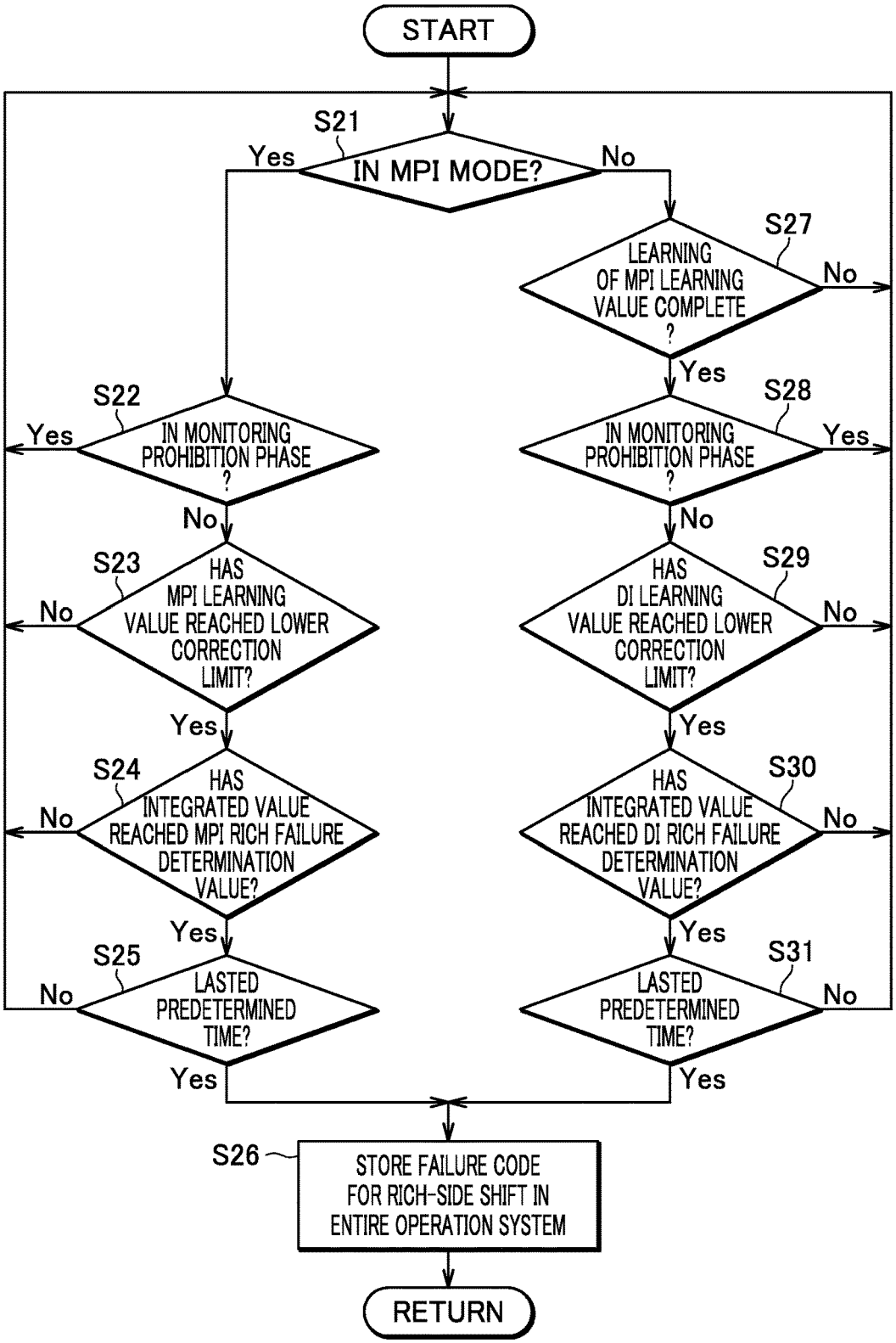
FIG. 3 is a flowchart illustrating a rich-side air-fuel ratio shift failure determination routine also executed by the ECU 31.

The determination process for the lean-side air-fuel ratio shift failure has been described above. In parallel with the determination process, the ECU 31 executes a determination process for a rich-side air-fuel ratio shift failure based on a routine illustrated in FIG. 3 (first failure determiner). This process basically differs, in contents, from the above-described process only in that, instead of the lean fluctuation in the air-fuel ratio, a rich fluctuation in the air-fuel ratio is dealt with, and will thus be summarized below.

When a determination in step S21 is Yes, indicating that the engine is in the MPI mode, the routine waits, in step S22, for the time of the monitoring prohibition phase to elapse. Subsequently, the ECU 31 determines in step S23 whether or not the MPI learning value has reached a lower correction limit, and in the subsequent step S24 whether or not the integrated value has reached an MPI rich failure determination value.

When the conditions in steps S23 and S24 remain satisfied for a predetermined time, a determination in step S25 is Yes and the routine shifts to step S26. In step S26, a failure code is stored that is indicative of a rich-side air-fuel ratio shift failure in the entire operation system for the engine 1. The routine is thus ended.

If the determination in step S21 is No, indicating that the engine is in the MPI+DI mode, the ECU 31 determines whether or not learning of the MPI learning value is completed. When the determination in step S27 is Yes, the routine shifts to step S28. Then, when the time of the monitoring prohibition phase elapses, the ECU 31 determines in step S29 whether or not the DI learning value has reached a lower correction limit, and in the subsequent step S30 whether or not the integrated value has reached a DI rich failure determination value.

When the conditions in steps S29 and S30 remain satisfied for a predetermined time, a determination in step S31 is Yes and the routine shifts to step S26 to store the failure code indicative of a rich-side air-fuel ratio shift failure in the entire operation system for the engine 1.

Then, the ECU 31 makes both a lean-side air-fuel ratio shift failure determination and a rich-side air-fuel ratio shift failure determination while the engine is in operation in each of the MPI mode and the MPI+DI mode. When occurrence of an air-fuel ratio shift failure is determined in one of the modes, the ECU 31 initiates an air-fuel ratio shift failure locating routine illustrated in FIG. 4 and FIG. 5 (second failure determiner and failure locator).

First, in step S41, the ECU 31 determines whether or not occurrence of a failure is determined in the MPI mode, and when the determination is Yes, the routine shifts to step S42. In step S42, the ECU 31 determines whether or not the current drive cycle (a period from engine start until operation stop resulting from turn-off of the ignition) is ended. If the determination in step S42 is No, then in step S43, the ECU 31 calculates a first filling efficiency Ec1 (first filling efficiency) from the intake air amount detected by the AFS 36, and also calculates a second filling efficiency Ec2 (second filling efficiency) from the intake manifold pressure Pin detected by the intake air pressure sensor 37 and an engine rotation speed Ne based on a crank angle signal. The ECU 31 then determines whether or not the filling efficiencies Ec1 and Ec2 are substantially equal.

Regardless of whether occurrence of an air-fuel ratio shift failure is determined on the lean side or the rich side, the failure may not only have occurred in the fuel system but may also be indicated due to erroneous detection by the AFS 36. In the latter case, an excessive or insufficient amount of fuel fed into the cylinder respectively fluctuates the air-fuel ratio toward the lean side or the rich side, leading to a determination of occurrence of an air-fuel ratio shift failure. The processing in the above-described step S43 is intended to exclude erroneous detection by the AFS 36 from the causes of a determination, in the MPI mode, of occurrence of an air-fuel ratio shift failure to extract a failure in the fuel system itself.

That is, if the intake air amount is detected normally by the AFS 36, the calculated filling efficiencies Ec1 and Ec2 are to be substantially equal. When the determination in step S43 is No, the AFS 36 may have failed, resulting in erroneous detection. In this case, the routine shifts to step S44 to end the routine while maintaining the failure code for the MPI mode (a lean- or rich-side air-fuel ratio shift failure in the entire operation system) resulting from the above-described step S6 or step S26. In this case, the failure corresponds to the entire operation system but is likely to be attributed to a failure in the AFS 36. In that sense, possible failure locations are assumed to have been narrowed down.

When the determination in step S43 is Yes, indicating that the filling efficiencies Ec1 and Ec2 are substantially equal, the routine shifts to step S45 to determine whether or not the intake air amount Qa detected by the AFS 36 is smaller than or equal to a preset determination value Qa0 (information on fuel cut during deceleration of the vehicle can also be utilized), and in the subsequent step S46, determine whether or not the intake manifold pressure Pin (the intake air pressure according to the present invention, in this case, a negative pressure) is lower than or equal to a preset determination value Pin0.

Possible causes of an air-fuel ratio shift failure include, besides a failure in the fuel system, inappropriate attachment of piping or suction of outside air or leakage of intake air caused by deterioration of sealing, in the intake system (a region from the throttle valve 20 to the intake valve 9) of the engine 1. For example, suction of outside air results from slip-out of a not illustrated positive crankcase ventilation (PCV) hose through which fuel evaporative emissions in the crankcase are introduced into the intake system, and an excess amount of intake air is fed into the cylinder of the engine 1 to fluctuate the air-fuel ratio toward the lean side, leading to a determination of occurrence of a lean-side air-fuel ratio shift failure.

As described above, if the intake negative pressure is actually established in an operation region where the negative pressure is to be applied to the intake system (hereinafter referred to as an intake negative pressure generation region) (this corresponds to "generation of the intake air pressure corresponding to the current operation region" according to the present invention), all the attachments to the intake system are determined to be appropriate. As a result, inappropriate attachment to the intake system can be excluded from the causes of a determination, in the MPI mode, of occurrence of an air-fuel ratio shift failure to extract a failure of an air-fuel ratio sift in the fuel system itself. Verification for this case is the purpose of the processing in the above-described steps S45 and S46. That is, the intake negative pressure generation region is determined in step S45 based on the intake air amount Qa≤determination amount Qa0 (or fuel cut information), and establishment of the intake negative pressure is determined in step S46 based on Pin determination value Pin0.

The operation region of the engine 1 varies according to operation of an accelerator, a traveling state of the vehicle, and the like, and thus, the current drive cycle may not involve shifting to an engine operation region where whether the intake negative pressure has been generated is to be determined. In that case, the routine shifts from step S45 through step S42 to the above-described step S44. In step S44, with the failure code resulting from the above-described step S6 (a lean- or rich-side air-fuel ratio shift failure in the entire operation system) maintained, the routine is ended.

In this case, narrowing-down of the failure location is precluded. However, if shifting to the intake negative pressure generation region is performed during the drive cycle as described below, regardless of whether or not the predetermined intake negative pressure is present, the failure location can be narrowed down based on the determination result. The processing in step S45 regarding the intake negative pressure generation region continues until the end of the drive cycle (engine stop), allowing opportunities to narrow down the failure location to be increased as much as possible.

However, the routine need not necessarily wait until the end of the drive cycle, and for example, the determination process in steps S45 and S46 may be ended, for example, when a predetermined time elapses.

On the other hand, when the determination in step S46 is No, indicating that the intake negative pressure is not established, the routine shifts to the above-described step S44, and is ended with the failure code resulting from the above-described step S6 (a lean-side air-fuel ratio shift failure in the entire operation system) maintained. In this case, the cause of the lean-side air-fuel ratio shift failure in the entire operation system is likely to be suction of outside air into the intake system. In that sense, possible failure locations are assumed to have been narrowed down.

When the determination in step S46 is Yes, indicating that the intake negative pressure is established, the routine shifts to step S47 to prohibit execution of a purge process during the MPI+DI mode (a purge process prohibiter according to the present invention; prohibition of execution of the purge process is hereinafter referred to as purge cut). As is well known, the purge process is control involving causing fuel evaporative emissions generated in a fuel tank 38 to be temporarily adsorbed to a canister 39, and during the subsequent operation of the engine 1, feeding the fuel evaporative emissions adsorbed to the canister 39 to the intake system via a purge control valve 40 controlled by the ECU 31 and then into the cylinder. For example, the purge process is executed every predetermined time, but during a period when purge cut is requested, the purge process remains suspended even when an execution timing arrives. That is, the purge control valve 40 has a closed state thereof maintained by the ECU 31.

As described below, the purge cut is continued until the failure determination in the MPI+DI mode is completed. However, since the fuel evaporative emissions are continuously adsorbed to the canister 39 during the purge cut, the purge process is desirably continued if the purge cut is unwanted. If the determination in step S45 is No, indicating that the AFS 36 has failed or if the determination in step S46 is No, indicating that the intake negative pressure is not established, the failure determination is not continued in either case, and thus, the purge cut is unwanted. In these cases, the purge cut in step S47 is cancelled and the purge process is continued, thus advantageously allowing the fuel evaporative emissions in the fuel tank 38 to be treated normally.

In the subsequent step S48, the ECU 31 determines whether or not the monitoring prohibition phase is being executed. This determination is intended to prevent an erroneous determination resulting from a fluctuation in air-fuel ratio, for example, as is the case with the above-described step S2. When the determination in step S48 is No, the ECU 31 determines in step S49 whether or not the intake air amount detected by the AFS 36 during the MPI+DI mode is greater than or equal to a preset determination value Qa1. This determination is intended to eliminate a variation in air-fuel ratio resulting from a significant adverse effect of a change in air amount.

When the determination in step S49 is Yes, if the DI learning value is updated in an operation region with the intake air amount Qa determination value Qa1, the ECU 31 further determines in step S50 whether or not the sum of the DI learning value and the integrated value falls within a preset normal range.

The processing in step S50 is intended to make a failure determination based on the fluctuation statuses of the DI learning value and the integrated value, for example, as is the case with the above-described steps S3 and S4. However, the contents of the processing in step S50 are simplified. The result of the processing in steps S3 and S4 already indicates that occurrence of a lean-side air-fuel ratio shift failure in the MPI fuel system is not certain but possible. Thus, step S50 is intended to negate a failure in the DI fuel system (determine the DI fuel system to be normal) to reconfirm the determination result in steps S3 and S4.

As described above, the learning value is updated after the integrated value remains biased toward the rich side or the lean side for a given period. A significant increase in integrated value allows update of the learning value to be predicted. Thus, in view of this prediction and the intention of step S50, a determination may be made without any problem at a timing when the learning value increases, and based on this viewpoint, step S50 is executed. As a result, a determination of occurrence of failure in the DI fuel system is immediately made without the need to wait for update of the DI learning value.

When the condition in step S50 is not satisfied and the determination in this step is No, the routine shifts to step S51 with the failure code resulting from the above-described step S6 or step S26 (a lean- or rich-side air-fuel ratio shift failure in the entire operation system) maintained. In the subsequent step S52, the routine cancels the request for purge cut and is ended. In this case, the AFS 36 is determined to be normal based on satisfaction of the conditions in step S43, and the intake system is determined to include no inappropriate attachment based on satisfaction of the conditions in steps S45 and S46. Therefore, these failures may be excluded from the failures in the entire operation system, and in this sense, possible failure locations are assumed to have been narrowed down.

When the determination in step S50 is Yes, the routine shifts to step S53. If the above-described conditions have lasted a predetermined cumulative time (for example, 20 sec) and the determination in step S53 is Yes, the routine shifts to step S54. In step S54, a failure code indicative of an air-fuel ratio shift failure in the MPI fuel system is stored, and then the routine shifts to step S52.

When the determinations in steps S50 and S53 are Yes, the ECU 31 assertively determines not only that the DI fuel system is normal but also that no external factors such as a failure in the intake system or the ignition system have occurred. Normal setting of the learning and integrated values in step S50 needs not only normal functioning of the DI fuel system but also normal functioning of the entire engine operation system except for the MPI fuel system, allowing, for example, the intake air amount and ignition timings to be appropriately controlled.

As a result, even when occurrence of a failure is determined in the last MPI mode, the intake system and the ignition system may be determined to be functioning normally with no external factors occurring, and the determination of occurrence of a failure in spite of such a normal status may be assumed to be attributed to a failure in the MPI fuel system itself.

Moreover, the above-described erroneous detection by the AFS 36 and suction of outside air into the intake system are both failures included in the external factors, and in the present embodiment, the processing in step S43 and in steps S45 and S46 actively confirms that these failures have not occurred. This allows the absence of external factors to be more assertively determined, and also allows the failure code (an air-fuel ratio shift failure in the MPI fuel system) to be more reliably set in the above-described step S54 so as to be more useful for subsequent repairs.

As described above, in the present embodiment, in both cases where a lean-side shift failure is determined in the MPI mode (step S6) and where a rich-side shift failure is determined (step S26), execution of the purge process is prohibited via the purge cut request when a failure determination is made again in the MPI+DI mode. In a case where fuel evaporative emissions are introduced into the cylinder in the engine 1, the air-fuel ratio tends to fluctuate toward the rich side compared to a case where no fuel evaporative emissions are introduced. Thus, the result of a failure determination differs between the case where the fuel evaporative emissions are introduced and the case where no fuel evaporative emissions are introduced. Therefore, when a failure determination is made at an indifferent timing regardless of whether or not the fuel evaporative emissions are introduced, an error may occur in the determination result. In the present embodiment, execution of the purge process is prohibited to allow a failure determination to be constantly made when no fuel evaporative emissions are introduced into the cylinder, enabling significant improvement of accuracy of the failure determination process and thus of reliability of the determination of occurrence of a failure in the MPI fuel system itself.

If no external factors have occurred and the corresponding code is set in step S54, cancellation of the request for purge cut in step S52 may be performed at any timing during the current drive cycle. On the other hand, during the purge cut, fuel evaporative emissions are continuously adsorbed to the canister 39 as described above, and the continuance is desirably as short as possible. In the present embodiment, when a determination result is obtained in steps S50 and S53, the request for purge cut is immediately cancelled to resume the purge process, allowing suppression and minimization of adsorption of the fuel evaporative emissions to the canister 39 during the purge cut. This also allows the purge process to be advantageously resumed with the fuel evaporative emissions enabled to be successfully adsorbed to the canister 39.

The failure determination process in the MPI+DI mode in a case where occurrence of an air-fuel ratio shift failure is determined in the MPI mode has been described. In contrast, if occurrence of an air-fuel ratio shift failure is determined in the MPI+DI mode, a similar failure determination process is executed in the MPI mode. This process basically differs, in contents, from the above-described process only in that, instead of the lean- or rich-side air-fuel ratio shift failure detection in the MPI mode, lean- or rich-side air-fuel ration shift failure detection in the MPI+DI mode is dealt with, as illustrated in FIG. 5, and will thus be summarized below.

Figure 4:
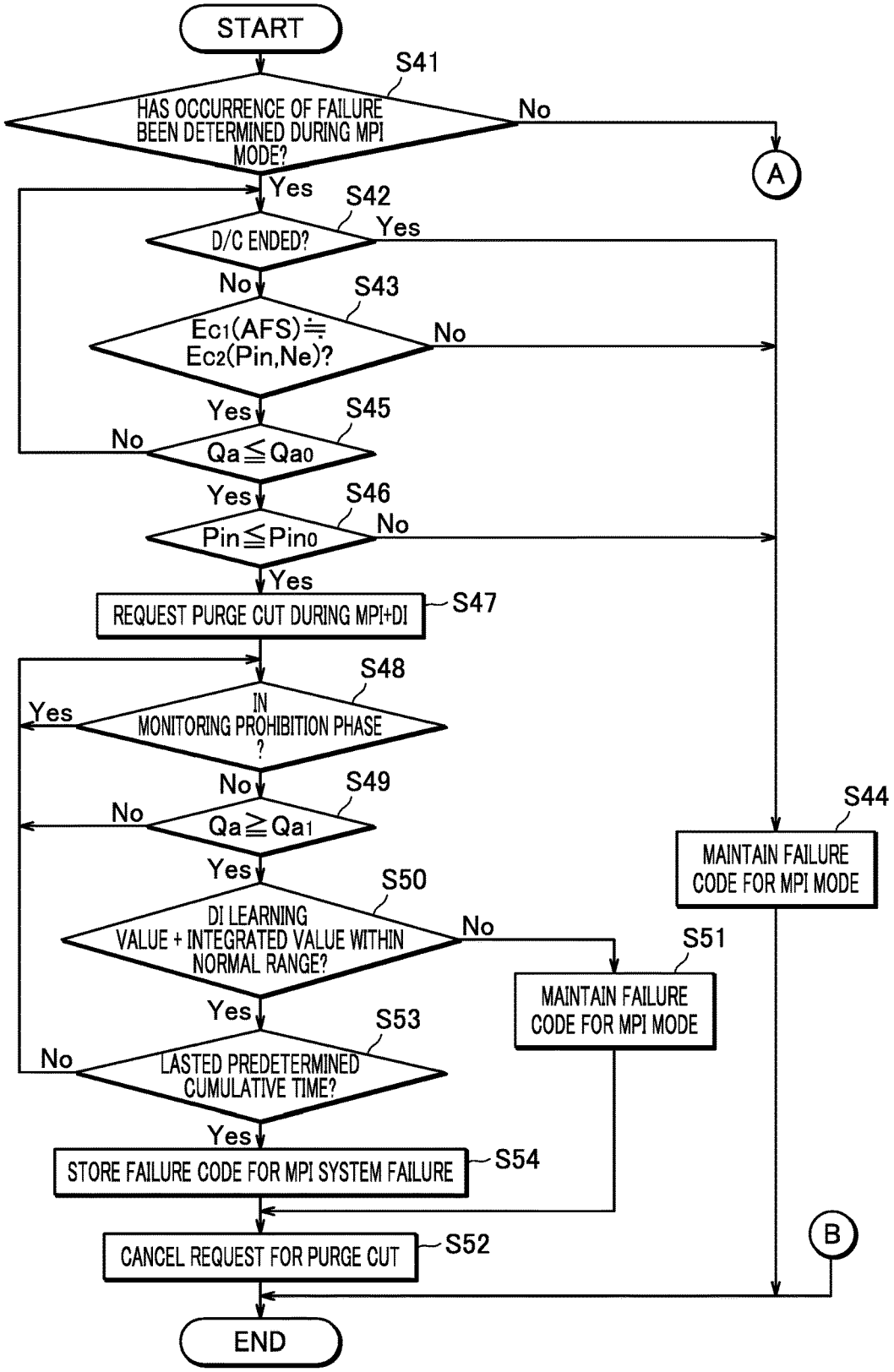
FIG. 4 is a flowchart illustrating an air-fuel ratio shift failure locating routine also executed by the ECU 31.
Figure 5:
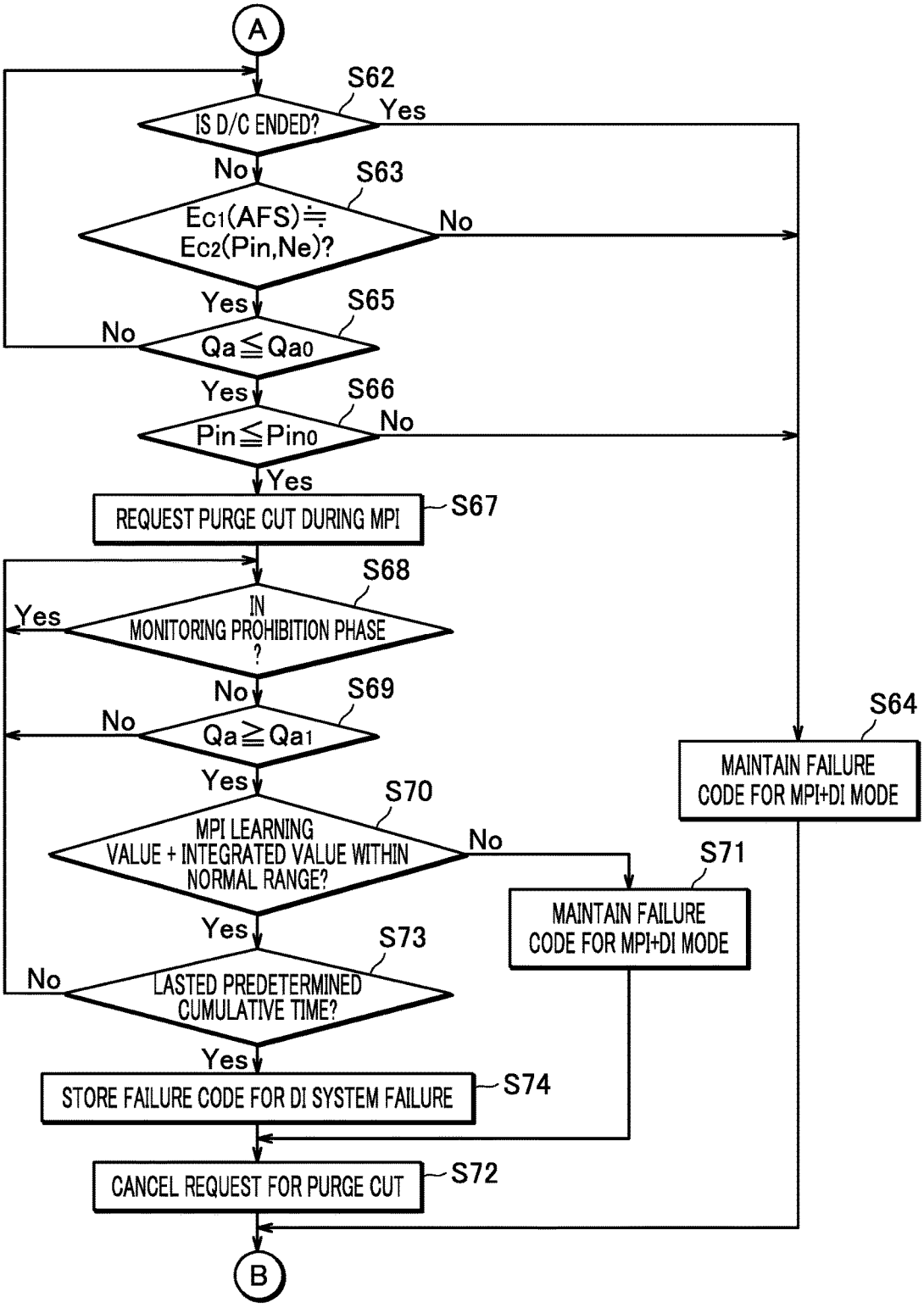
FIG. 5 is a flowchart illustrating the air-fuel ratio shift failure locating routine also executed by the ECU 31.

When the determination in step S41 in FIG. 4 is No, the process shifts to step S62 in FIG. 5, where the ECU 31 determines whether or not the current drive cycle has ended. When the determination in step S62 is No, the ECU 31 determines in step S63 whether or not the filling efficiencies Ec1 and Ec2 are substantially equal. When the determination in step S63 is No, the process shifts to step S64 to maintain the failure code for the MPI+DI mode.

When the determination in step S63 is Yes, the ECU 31 determines in steps S65 and S66 whether or not the intake negative pressure is actually established in the intake negative pressure generation region.

When the determination in step S66 is Yes based on the established intake negative pressure, the ECU 31 requests purge cut during the MPI mode in step S67. When the determination in the subsequent step S68 is No, indicating that the monitoring prohibition phase is not being executed, the ECU 31 determines in step S69 whether or not, in the MPI mode, the intake air amount Qa is greater than or equal to the preset determination value Qa1. When the determination in S69 is Yes, if, in step S70, the MPI learning value is updated during the MPI mode, the ECU 31 further determines whether or not the sum of the MPI learning value and the integrated value falls within a normal range. When the determination in step S69 is No, the ECU 31 maintains the failure code for the MPI+DI mode in step S71 and cancels the request for purge cut in the subsequent step S72.

When the determination in step S70 is Yes, the routine shifts to step S73. If the above-described conditions have lasted a predetermined cumulative time and the determination in step S73 is Yes, the routine shifts to step S74. In step S74, a failure code indicative of an air-fuel ratio shift failure in the DI fuel system is stored, and the routine subsequently shifts to step S72.

Execution of the purge process is prohibited via the purge cut request when a failure determination is made again in the MPI mode based on the determination of an air-fuel ratio shift failure in the MPI+DI mode. Therefore, although duplicate descriptions are omitted, the adverse effects of fuel evaporative emissions on the air-fuel ratio can be eliminated, significantly improving the accuracy of the failure determination process and thus the reliability of the determination of occurrence of a failure in the DI fuel system itself.

As described above, prohibition of execution of the purge process reduces errors in failure determinations. However, in view of prevention of atmospheric emission of diffused gas, prohibition of execution of the purge process is preferably avoided. In the failure detection apparatus according to the present embodiment, the lean-side air-fuel ratio shift failure determination routine (FIG. 2) or the rich-side air-fuel ratio shift failure determination routine (FIG. 3), which is the first failure determiner, does not involve prohibition of execution of the purge process. Furthermore, unless occurrence of a failure is determined by the first failure determiner, no failure determination process is executed by the air-fuel ratio shift failure locating routine (FIG. 4) or the air-fuel ratio shift failure locating routine (FIG. 5), which is the second failure determiner. Thus, as long as no failure occurs in the MPI mode or in the MPI+DI mode, execution of the purge process is not prohibited. Consequently, also in this regard, atmospheric emission of diffused gas can be suppressed.

The embodiment has been described above. However, the aspects of the present invention are not limited to the embodiment. For example, the above-described embodiment is intended for the engine 1 capable of switching between the two types of injection forms including the MPI mode for port injection and the MPI+DI mode for both port injection and cylinder injection. However, the present invention is not limited to these injection forms. For example, the embodiment may be intended for an engine capable of switching between a diffusive combustion mode in which fuel is diffused and combusted in the cylinder in the engine 1 and a pre-mixed combustion mode for pre-mixed combustion. Alternatively, the embodiment may be intended for an engine capable of switching between a mode in which only one injector of a pair of port injectors provided in an intake port is driven and a mode in which both injectors are driven. Alternatively, the embodiment may be intended for an engine capable of switching among three or more types of injection forms.

Furthermore, in the above-described embodiment, when occurrence of a lean-side air-fuel ratio shift failure is determined in either the MPI+DI mode or the MPI mode, the failure determination process is executed on condition that the intake negative pressure is actually established in the generation region of the intake negative pressure (the determinations in steps S45 and S46 or the determinations in steps S65 and S66 are Yes). Thus, the embodiment actively checks that no suction of outside air has resulted from inappropriate pipe connection in the intake system such as slip-out of a PCV hose or inappropriate sealing in the intake system.

Based on an idea similar to the above-described idea, establishment of the intake negative pressure based on the intake air pressure detected by the intake air pressure sensor 37 may be added as a shift condition for determining whether or not the sum of the learning value and the integrated value falls within a preset normal range after mode switching (step S50 or step S70) if the first failure determiner has determined an air-fuel ratio shift failure on the lean side (step S6). This is to eliminate the possibility that the determination of an air-fuel ratio shift failure on the lean side by the first failure determiner is caused by suction of outside air into the intake system, to determine that the sum of the learning value and the integrated value does not deviate from the normal range after mode switching.

Furthermore, for an engine including a supercharger such as a turbocharger, establishment of a supercharging pressure may be added as a condition for shifting to step S50 or step S70 in a case where the first failure determiner determines occurrence of an air-fuel ratio shift failure on the rich side (step S26). This is to eliminate the possibility that the determination of an air-fuel ratio shift failure on the rich side by the first failure determiner is caused by leakage of outside air into the intake system, to determine that the sum of the learning value and the integrated value does not deviate from the normal range after mode switching.

An object of the present invention is to provide a failure detection apparatus for fuel systems of an engine, the failure detection apparatus being intended for an engine capable of switching between a plurality of injection forms, the failure detection apparatus being capable of eliminating erroneous failure detection caused by external factors other than the fuel systems to reliably determine a failure in the fuel systems responsible for the respective injection forms.

In the failure detection apparatus for the fuel systems of the engine configured as described above, while the engine is in operation in each of the first injection form and the second injection form, a failure determination process is executed on the corresponding fuel system, and when occurrence of a failure is determined during operation in one of the injection forms, the failure determination process is executed during operation in the other injection form. Then, based on the result of the failure determination, whether or not the failure has occurred is assertively determined for each of the fuel systems responsible for the first and second injection forms.

When occurrence of a failure is determined during operation in one of the injection forms, the failure may not only have occurred in the fuel system responsible for the one of the injection forms but may also be indicated, for example, due to an external factor such as a failure in the intake system or the ignition system, preventing the determination of which is the cause of the determination. In this case, according to the present invention, the failure determination process is executed during operation in the other injection form, and for example, if occurrence of a failure has not been determined, not only is the fuel system in the other injection form determined to be normal but the absence of external factors is also assertively determined. As a result, the absence of external factors can also be assertively determined when occurrence of a failure is determined during operation in the last one of the injection forms, and the determination of occurrence of a failure in spite of such a normal status may be assumed to be attributed to a failure in the fuel system itself that corresponds to the one of the injection forms.

When a second failure determiner executes the failure determination process for the fuel systems, a purge process inhibitor prohibits execution of a purge process. The result of the failure determination processes differs between the case where fuel evaporative emissions are introduced into a cylinder in the engine and the case where no fuel evaporative emissions are introduced. Therefore, when a failure determination process is executed at an indifferent timing regardless of whether or not the fuel evaporative emissions are introduced, an error may occur in the determination result. In the present embodiment, execution of the purge process is prohibited to allow a failure determination process to be constantly executed when no fuel evaporative emissions are introduced into the cylinder, enabling significant improvement of accuracy of the failure determination process and thus of reliability of the determination of occurrence of a failure in the fuel system itself that corresponds to the one of the injection forms.

Although prohibition of execution of the purge process reduces errors in failure determinations, in view of prevention of atmospheric emission of diffused gas, prohibition of execution of the purge process is preferably avoided. In the failure detection apparatus according to the present invention, the first failure determiner does not involve prohibition of execution of the purge process. Furthermore, unless occurrence of a failure is determined by the first failure determiner, no failure determination process is executed by the second failure determiner. Thus, as long as no failure occurs in the first injection form or in the second injection form, execution of the purge process is not prohibited. Consequently, atmospheric emission of diffused gas can be suppressed.

Therefore, the failure detection apparatus for the fuel systems of the engine according to the present invention is intended for an engine capable of switching between a plurality of injection forms. The failure detection apparatus is capable of eliminating erroneous failure detection caused by external factors other than the fuel systems to reliably determine a failure in the fuel systems responsible for the respective injection forms.

The invention thus described, it will be obvious that the same may be varied in many ways. Such variations are not to be regarded as a departure from the spirits and the scope of the invention, and all such modifications as would be obvious to one skilled in the art are intended to be included within the scope of the following claims.

What is claimed is:

1. A failure detection apparatus for fuel systems of an engine capable of switching between a first injection form and a second injection form, the failure detection apparatus comprising:

a first failure determiner executing, while the engine is in operation in each of the first and second injection forms, a failure determination process on the corresponding fuel system;

a second failure determiner executing, when the first failure determiner determines occurrence of a failure during operation in one of the injection forms, a failure determination process on the fuel system corresponding to the other injection form during operation in the other injection form;

a failure locator assertively determining whether or not the failure has occurred, for each of the fuel systems responsible for the first and second injection forms, based on a result of the failure determination process by the second failure determiner; and a purge process prohibiter prohibiting execution of a purge process of causing fuel evaporative emissions generated in a fuel tank to be adsorbed to a canister and introducing the fuel evaporative emissions into a cylinder while the engine is in operation, wherein when the second failure determiner executes the failure determination process on the fuel system, the second failure determiner causes the purge process prohibiter to prohibit execution of the purge process.

2. The failure detection apparatus for the fuel systems of the engine according to claim 1, wherein the first failure determiner determines occurrence of a failure in the fuel system based on a fluctuation in air-fuel ratio toward a rich side or a lean side of the engine, and when the first failure determiner determines occurrence of a failure, the second failure determiner executes, during operation in the other injection form, the failure determination process on the corresponding fuel system on condition that a predetermined intake air amount is satisfied in a current operation region of the engine.

3. The failure detection apparatus for the fuel systems of the engine according to claim 2, wherein the engine further comprises an intake air pressure detector detecting a pressure in an intake passage located downstream of a throttle valve, and when the first failure determiner determines occurrence of a failure based on the fluctuation in air-fuel ratio toward the lean side, the second failure determiner executes, during operation in the other injection form, the failure determination process on the corresponding fuel system on condition that the intake air pressure detector detects a value smaller than or equal to a predetermined pressure.

4. The failure detection apparatus for the fuel systems of the engine according to claim 3, wherein the second failure determiner continues, until the engine is stopped, determination of whether or not the intake negative pressure is established or whether or not a supercharging pressure is established.

5. The failure detection apparatus for the fuel systems of the engine according to claim 2, wherein the engine further comprises a supercharger supercharging intake air in a predetermined operation region, and a supercharging state determiner detecting whether or not the supercharger is supercharging the intake air, and when the first failure determiner determines occurrence of a failure based on a fluctuation in air-fuel ratio toward the rich side, the second failure determiner executes, during operation in the other injection form, the failure determination process on the corresponding fuel system on condition that the supercharging state determiner determines that supercharging is performed in the predetermined operation region.

6. The failure detection apparatus for the fuel systems of the engine according to claim 2, wherein when the second failure determiner executes the failure determination process on the fuel system, if the engine experiences a predetermined operation state before execution of the purge process is prohibited, the second failure determiner determines whether or not the intake air pressure detector has detected a value smaller than or equal to a corresponding predetermined pressure, and in a case where the intake air pressure is not generated, prohibition of execution of the purge process is cancelled.

7. The failure detection apparatus for the fuel systems of the engine according to claim 1, further comprising an intake air amount detector detecting an intake air amount of the engine, wherein when the first failure determiner determines occurrence of a failure, the second failure determiner executes, during operation in the other injection form, the failure determination process on the corresponding fuel system on condition that a first filling efficiency determined from an intake air amount detected by the intake air amount detector is substantially equal to a second filling efficiency determined from an intake air pressure and a rotation speed of the engine.

8. The failure detection apparatus for the fuel systems of the engine according to claim 1, wherein the second failure determiner causes the purge process prohibiter to prohibit execution of the purge process when starting the failure determination process on the fuel system, and causes the purge process prohibiter to cancel the execution prohibition immediately when a result of the failure determination process is obtained.

* * * * *